US006547243B2

(12) United States Patent
Juenger

(10) Patent No.: US 6,547,243 B2
(45) Date of Patent: Apr. 15, 2003

(54) PORTABLE THREE DIMENSIONAL PUZZLES

(76) Inventor: Arthur William Juenger, 2017 Bentley Manor, Fenton, MO (US) 63026

( * ) Notice: Subject to any disclaimer, the term of this patent is extended or adjusted under 35 U.S.C. 154(b) by 0 days.

(21) Appl. No.: 09/773,851

(22) Filed: Feb. 2, 2001

(65) Prior Publication Data

US 2002/0105138 A1 Aug. 8, 2002

(51) Int. Cl.[7] ..... A63B 9/08
(52) U.S. Cl. ..... 273/157 R
(58) Field of Search ..... 273/157 R, 153 R, 273/156

(56) References Cited

U.S. PATENT DOCUMENTS

| | | | | | |
|---|---|---|---|---|---|
| 3,584,369 | A | | 6/1971 | de Montebello | |
| 3,692,312 | A | * | 9/1972 | Meyer | 273/157 R |
| 4,258,920 | A | * | 3/1981 | Wladron et al. | 273/157 R |
| 4,935,335 | A | | 6/1990 | Fotland | |
| 5,158,295 | A | * | 10/1992 | Shilling | 273/157 R |
| 5,274,937 | A | | 1/1994 | Birnbaum | |
| D359,995 | S | | 7/1995 | Figone | |
| 5,429,372 | A | | 7/1995 | Spaziani et al. | |
| 5,664,861 | A | * | 9/1997 | Asada et al. | 362/31 |
| D392,002 | S | | 3/1998 | Harvey | |
| 5,967,032 | A | | 10/1999 | Bravenec et al. | |
| 6,435,502 | B2 | * | 8/2002 | Matos | 273/157 R |

* cited by examiner

*Primary Examiner*—Steven Wong

(57) ABSTRACT

A portable jig-saw puzzle comprising a back plate integrally provided with magnetically attractive material extending substantially across its entire area, and a puzzle board, said puzzle board comprising four layers, the outer layer being a lenticular lens sheet provided with a flat face and a face which includes a plurality of outwardly presented parallel lenslets, an imaging layer disposed against the flat face of the lens sheet in registration with the lenslets, a reflecting layer disposed behind the imaging layer, the imaging layer and reflecting layer being mutually adapted for reflecting light through the imaging layer and out the lens face, and a base sheet integrally provided with a plethora of tiny magnets, said puzzle board being divided into a plurality of small pieces, each of which may be selectively attached to either side of the back plate.

6 Claims, 2 Drawing Sheets

PORTABLE THREE DIMENSIONAL PUZZLES

BACKGROUND OF THE INVENTION

The construction, uses and design considerations of lenticular lenses are well known in the art and are disclosed in U.S. Pat. No. 3,584,369 issued Jun. 15, 1971 to de Montebello, and U.S. Pat. No. 4,935,335 issued Jun. 19, 1990 to Fotland.

Jig saw puzzles have existed for decades as conventional forms of amusement and entertainment. Puzzle solvers regularly enjoy the mental exercises in shape, space and color identification and recognition provided by such puzzles. Experienced puzzle solvers find simple and uncomplicated puzzles boring and seek out more complex puzzle offerings. To satisfy the need for complexity, puzzle designers and manufacturers have usually increased the total number of puzzle pieces or decreased the color contrasts in their puzzles. Complex puzzles usually require tables or similar large flat surfaces which will be available for extended periods of time, and which will remain available until the puzzle is either solved or abandoned. There exists a need for complex puzzles which are smaller in size, which will not preclude the use and availability of household furniture while in the process of being solved, which will present substantial solving problems to the solver, and which may be conveniently stored while in a partially solved condition.

To satisfy these needs, applicant has invented a small, portable jig-saw puzzle sized and shaped for carrying in briefcases or folders or the like, which is complex and challenging to the experienced solver, and which provides mental challenges in depth, shape, space and color perception through three dimensions. Additionally applicant has provided a puzzle board to which each of the pieces may be selectively retained where placed so that properly located pieces may be retained in place on one side of the board and that the remaining pieces may be stored on the opposite side of the board when the solver so requires. Because of the puzzles' storage features, a solver no longer is required to decide whether to continue a partially solved puzzle or dismantle for a later day. The solver can now store the unlocated pieces on the reverse side of the magnetic board and place the board on a shelf or in a drawer or in a carrying case. A puzzle of the type hereinafter described may be stored for days, weeks and months, and it may be readily carried into places where people customarily look for something to occupy their time, such as in airports, doctor's offices or while traveling.

BRIEF SUMMARY OF THE INVENTION

It is the object of this invention to provide a portable jig saw puzzle depicting three dimensional subjects in three dimensional backgrounds including a solving board to which the individual pieces of the puzzle are magnetically attracted such that said pieces may be held in their correct position magnetically without the use of interlocking configurations, and which, during periods of non-use, may be readily stored in convenient locations.

IN THE DRAWINGS

Figure 2:
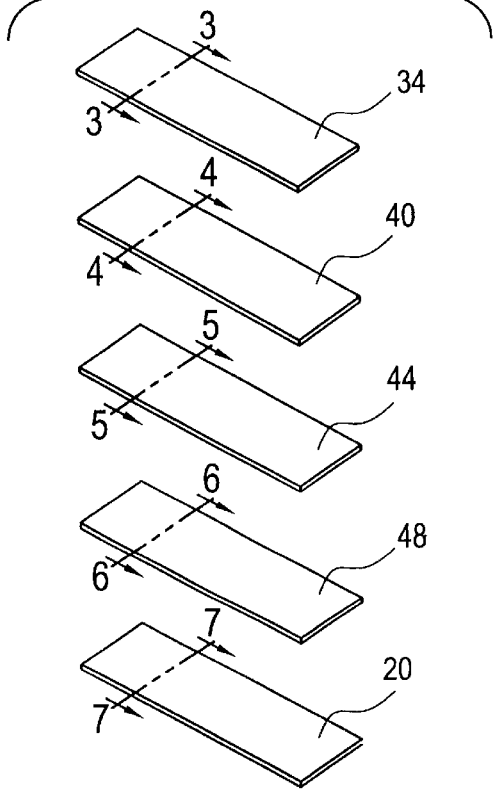
FIG. 2 is an exploded view of the various layers comprising my invention.
Figure 3:
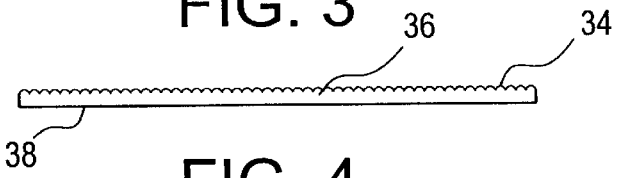
FIG. 3 is a sectional view taken along lines 3—3 of FIG. 2.
Figure 4:
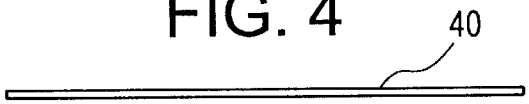
FIG. 4 is a sectional view taken along lines 4—4 of FIG. 2.
Figure 5:
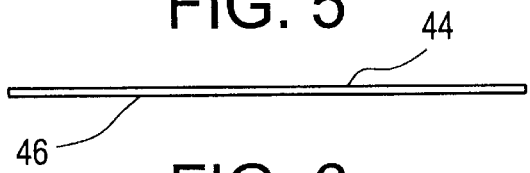
FIG. 5 is a sectional view taken along lines 5—5 of FIG. 2.
Figure 6:
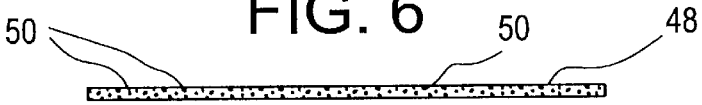
Figure 7:
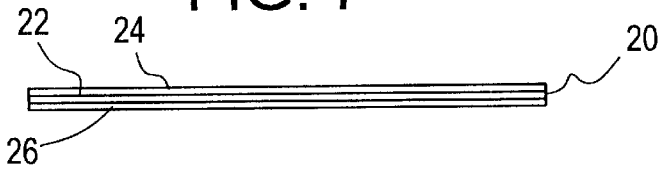
Figure 8:
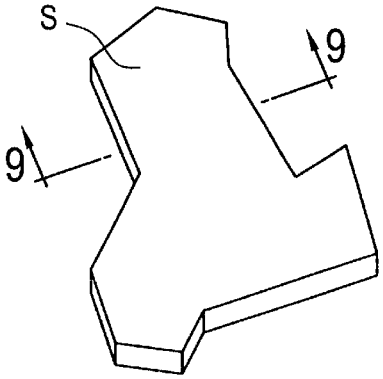

FIG. 6 sectional view taken along lines 6—6 of FIG. 2;

FIG. 7 sectional view taken along lines 7—7 of FIG. 2;

FIG. 8 is an enlarged view of a non-interlocking puzzle piece; and

Figure 9:
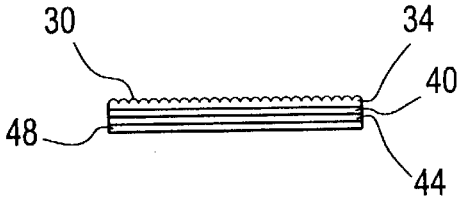

FIG. 9 is an enlarged fragmentary sectional view taken along lines 9—9 of FIG. 8.

DETAILED DESCRIPTION

Referring now in more detail by reference character to the drawings, which illustrate a preferred embodiment of my invention, A represents a three-dimensional jigsaw puzzle assembly comprising a base 20 and a puzzle board 30. The base 20 is preferably a flat sheet 22 of magnetically attractive material sandwiched between thin layers 24, 26, of soft material such as card stock or sheet plastic as best seen in FIG. 7.

The puzzle board 30 comprises an upper lenticular web 34 with its lenticles 36 presented outwardly and having an inwardly presented flat face 38 against which is disposed one side of a film 40 containing a collage of color dot patterns sized and aligned with the individual lenticles 36 to depict a three dimensional scene when viewed from a point spaced away from the outer face of the web 34. A reflecting sheet 44 of opaque highly reflective material which is preferably white in color is placed against the other side of the film 40 to reflect the light that passes through the web 34 and the film 40. Bonded or otherwise secured to the back 46 of the reflecting sheet 44 is a flexible sheet 48 of soft material embedded with numerous tiny magnetic particles 50.

Preferably the base 20 has more surface area than the board 30 whereby to allow random placement of segments S outside the puzzle area during puzzle assembly. It should be noted that the reflecting sheet 44 not only amplifies the brightness and richness of the colors on the puzzle design, but also enhances the 3-D effects and provides varying degrees of depth throughout the puzzle area scene.

Use and Operation

In use, the board 30 is cut into numerous smaller pieces S of varying shapes which may or may not be interlocking, depending upon the degree of solving difficulty desired. Each piece S will be magnetically attracted to the board 20 and will remain in the position placed on the board 20 by the solver until the solver moves it, because of the magnetic attraction between the magnetic particles 50 in the sheet 48 and the metallic sheet 22 in the base 20. Each pieces S will be retained where placed until manually moved, and if the solver desires to defer completion of the puzzle, the unplaced pieces S may be conveniently stored on the reverse side of the base 20 where they will be held magnetically until manually removed.

Three-dimensional puzzles are extremely difficult to solve, and provide numerous exercise in mental gymnastics. Because of the inherent difficulty, a challenging three dimensional puzzle can be provided on a much smaller surface than the conventional two dimensional puzzle and is readily adaptable for use wherever people are accustomed to spending long waiting periods looking for something to do such as at airports, and while traveling, particularly in automobiles and airplanes where freedom of movement is restricted and waiting boredom looms.

Figure 1:
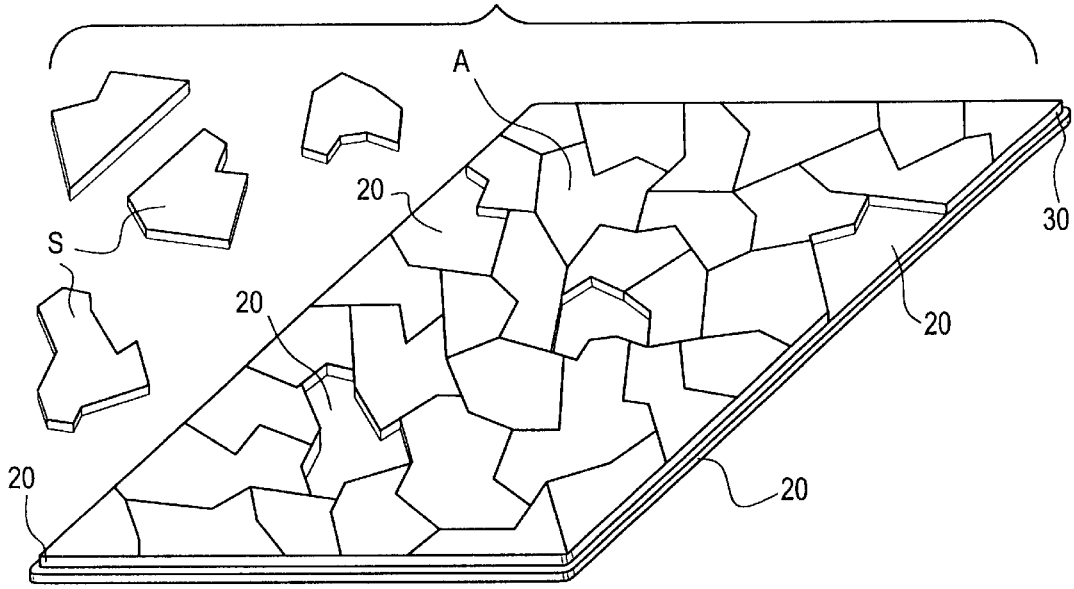
FIG. 1 is a perspective view of a preferred embodiment of my invention which has been substantially assembled.

It has been found that the most difficult puzzles to solve are created when the board 20 is cut into smaller pieces which do not have interlocking shapes, such as the pieces presented in FIGS. 1 and 8. In the non-interlocking configuration, the solver is required to align the lenticles as part of locating the piece. In the interlocking configuration, not shown, alignment of the lenticles becomes substantially easier.

If desired, the need for a separate reflecting layer 44 can be eliminated by spraying said other side of the film 40 with a highly reflective paint without departing from the nature and principle of my invention.

In a third preferred embodiment of my invention, the collage of color dot patterns 40 is printed directly on the flat face 38 of the web 34 and the flat face 38 of the web 34 is thereafter painted with highly reflective paint. The sheet 48 is then secured to the web 34.

It should be apparent that changes and substitutions in the unique and novel arrangement, combination, assembly and interaction of the various parts and components shown and described herein may be made without departing from the nature and principle of my invention.

I claim:

1. A portable puzzle comprising a back plate and a puzzle board, said puzzle board including a lenticular lens provided with a flat face and a lens face which includes a plurality of outwardly presented parallel lenticles, imaging means disposed against the flat face in registration with the lenticles, said imaging means comprising a plurality of spaced multicolor segments in registration with the lenticles in such manner that when viewed through the lenticles the segments will present a three dimensional depiction to the viewer, reflective means disposed behind the imaging means and partially exposed to the lens face, said reflective means being adapted for reflecting light back through the lens from the spaces between the segments and a base sheet.

2. The puzzle of claim 1 in which the imaging means comprises a sheet of film on which are disposed multicolor segments in registration with the lenticles on the lenticular sheet in such manner that when viewed through the lenticles the segments will present a three dimensional scene to the viewer, and the reflective means comprises a layer of highly reflective material disposed snugly against the image means in such manner that the area between the multicolor segments on the image means reflects light outwardly through the lenticular sheet toward the viewer.

3. The puzzle of claim 1 in which the imaging means comprises a sheet of film on which are disposed multicolor segments in registration with the lenticles on the lenticular sheet in such manner that when viewed through the lenticles the segments will present a three dimensional depiction to the viewer, the reflective means comprises a layer of highly reflective material disposed snugly against the image means in such manner that the area between the multicolor segments on the image means reflects light outwardly through the lenticular sheet toward the viewer, and the puzzle board is divided into many pieces of different size and shapes, each piece of which is magnetically attracted to and may be movably attached to the back plate.

4. A portable puzzle comprising a back plate integrally provided with a large flat sheet of permeable material extending substantially across its entire area, and a puzzle board, said puzzle board including an outer layer comprising an enlarged flat lenticular lens provided with an internally presented flat face and an outwardly presented lenticular lens face which includes a plurality of outwardly presented parallel lenticles, a first inner layer provided with a plurality of spaced multicolor segments in linear registration with the lenticles on the lenticular sheet in such manner that when viewed through the lenticles from a point away from the board, a three dimensional scene will be depicted to the viewer, a second inner layer provided with a highly reflective surface adapted for reflecting external light from between the individual segments back through the lenticles, and a base layer, filled with a plethora of spaced tiny magnets of sufficient magnetic strength to hold the puzzle board firmly against the back plate.

5. The puzzle of claim 4 in which the puzzle board is divided into many pieces of different size and shapes, each piece of which may be selectively and movably magnetically attached to the back plate.

6. The portable puzzle of claim 1 in which each multicolor segment is linear and extends across the flat face of the lens in spaced parallel relation to the lenticles.

* * * * *